United States Patent [19]

Lloyd et al.

[11] Patent Number: 4,623,576

[45] Date of Patent: Nov. 18, 1986

[54] LIGHTWEIGHT NONWOVEN TISSUE AND METHOD OF MANUFACTURE

[75] Inventors: William D. Lloyd; Maung H. Win, both of Neenah; Dennis E. Malueg, Fremont, all of Wis.

[73] Assignee: Kimberly-Clark Corporation, Neenah, Wis.

[21] Appl. No.: 789,982

[22] Filed: Oct. 22, 1985

[51] Int. Cl.[4] ..... B32B 5/14

[52] U.S. Cl. ..... 428/171; 428/288; 428/296; 428/297; 428/340; 428/903; 428/913

[58] Field of Search ..... 428/288, 340, 903, 913, 428/171, 297, 296

[56] References Cited

U.S. PATENT DOCUMENTS

| | | | |
|---|---|---|---|
| 2,988,469 | 12/1959 | Watson | 154/101 |
| 3,016,599 | 1/1962 | Perry, Jr. | 28/78 |
| 3,959,421 | 5/1976 | Weber | 264/6 |
| 3,971,373 | 7/1976 | Braun | 128/146.2 |
| 4,100,324 | 7/1978 | Anderson et al. | 428/903 |
| 4,298,649 | 11/1981 | Meitner | 428/198 |
| 4,307,143 | 12/1981 | Meitner | 428/171 |
| 4,426,417 | 1/1984 | Meitner et al. | 428/903 |
| 4,468,428 | 8/1984 | Early et al. | 428/221 |
| 4,469,734 | 9/1984 | Minto et al. | 428/134 |
| 4,493,868 | 1/1985 | Meitner | 428/903 |

FOREIGN PATENT DOCUMENTS

| | | | |
|---|---|---|---|
| 2104562 | 3/1981 | United Kingdom | 264/518 |

*Primary Examiner*—James J. Bell

*Attorney, Agent, or Firm*—Gregory E. Croft; Donald L. Traut; Jeremiah J. Duggan

[57] ABSTRACT

Tissue comprising a matrix of nonwoven fibers having a basis weight generally in the range of about 25 to 50 gsm. The matrix is a meltblown web having incorporated therein staple fibers. The combination provides highly-improved tissue properties as well as strength and absorbency required for many tissue applications. The tissues may be formed by a conventional meltblowing process involving extrusion of a thermoplastic polymer as a filament in air streams which draw and attenuate the filaments to fine fibers, having an average diameter of up to about 10 microns. The staple fibers may be added to the air stream, and the turbulence produced where the air streams meet results in a uniform integration of the staple fibers into the meltblown web. The matrix may contain from about 30 to about 80 weight percent polymer and have a subjective softness rating of at least about 10.

18 Claims, 2 Drawing Figures

LIGHTWEIGHT NONWOVEN TISSUE AND METHOD OF MANUFACTURE

BACKGROUND OF THE INVENTION

1. Field of the Invention

The present invention relates to materials for the manufacture of nonwoven tissues having particular softness and strength. The nonwoven material segment of the overall wiper market has grown due to the economy of such products, as well as the ability to tailor the wipers for specific applications. For example, nonwoven wipers are available having absorbency properties particularly suited for oil wiping, for food service wiping and for wiping of high technology electronic parts. Such nonwoven materials may be manufactured by a number of known processes, including wet-forming, air-forming and extrusion of thermoplastic fibers. The present invention is related to an improvement in nonwoven facial tissues formed using a meltblowing process to produce microfibers, incorporating particular cellulosic fibers having utility and diverse applications and particularly unique softness.

2. Description of the Pertinent Art

U.S. Pat. No. 4,426,417 discloses a wiper comprising a matrix of nonwoven fibers having a basis weight of 25 to 300 gsm including a meltblown web holding a staple fiber mixture therein. The matrix contains up to 90% fiber blend of which 90% is synthetic fibers.

Meltblown nonwoven microfiber materials are known and have been described in a number of U.S. Patents, including U.S. Pat. No. 4,328,279 to Meitner and Englebert, U.S. Pat. No. 4,298,649 to Meitner and U.S. Pat. No. 4,307,143 to Meitner. The preparation of thermoplastic microfiber webs is also known and described, for example, in Went, Industrial and Engineering Chemistry, Volume 48, No. 8 (1956), pages 1342 through 1346, as well as in U.S. Pat. Nos. 3,978,185 to Buntin, et al., 3,795,571 to Prentice and 3,811,957 to Buntin. These processes generally involve forming a low viscosity thermoplastic polymer melt and extruding filaments into a converging air stream which draws the filaments to fine diameters on the average of up to about 10 microns, which are then collected to form a nonwoven web. The addition of pulp to the air stream to incorporate the pulp into the meltblown fiber web is also known and described in U.S. Pat. No. 4,100,324 to Anderson, Sokolowski and Ostermeier.

While tissues produced in accordance with the disclosures of these patents have, in some cases, achieved good acceptance for a number of wiping applications, it remains desired to produce a nonwoven facial tissue having extremely high softness while maintaining good wiping properties, i.e., the ability to wipe quickly and having good strength. It is desired to produce such a facial tissue at a cost consistent with disposability and having strength properties for rigorous wiping applications. Wipers of the present invention attain to a high degree these desired attributes.

SUMMARY OF THE INVENTION

The present invention relates to a single-ply nonwoven facial tissue having a basis weight of between 20 and 50 g/m$^2$ and including thermoplastic microfibers having an average diameter in the range of up to about 10 microns and cellulosic fibers. Further, the invention relates to such improved tissues having not only excellent clean wiping properties but also good tactile and physical properties such as softness and strength. The tissue of this invention comprises a matrix of microfibers, preferably meltblown thermoplastic fibers having distributed throughout cellulosic fibers. Thermoplastic fibers are present in an amount of between about 30 and about 80 weight percent. Preferred embodiments include microfibers formed from polypropylene and mixtures of staple fibers having a coarseness coefficient below about 20, preferably about 15.

The tissue of this invention has been demonstrated to possess excellent clean wiping properties as determined by wiping residual tests, excellent absorbency for both oil and water as demonstrated by capillary suction tests and oil absorbency rate tests with both low and high viscosity oils and softness as demonstrated by softness facial tests against premium quality facial tissues. When compared with conventional facial tissues, the tissues of this invention exhibit a unique combination of performance, physical properties and the economy of manufacture.

DESCRIPTION OF THE PREFERRED EMBODIMENTS

Figure 1:
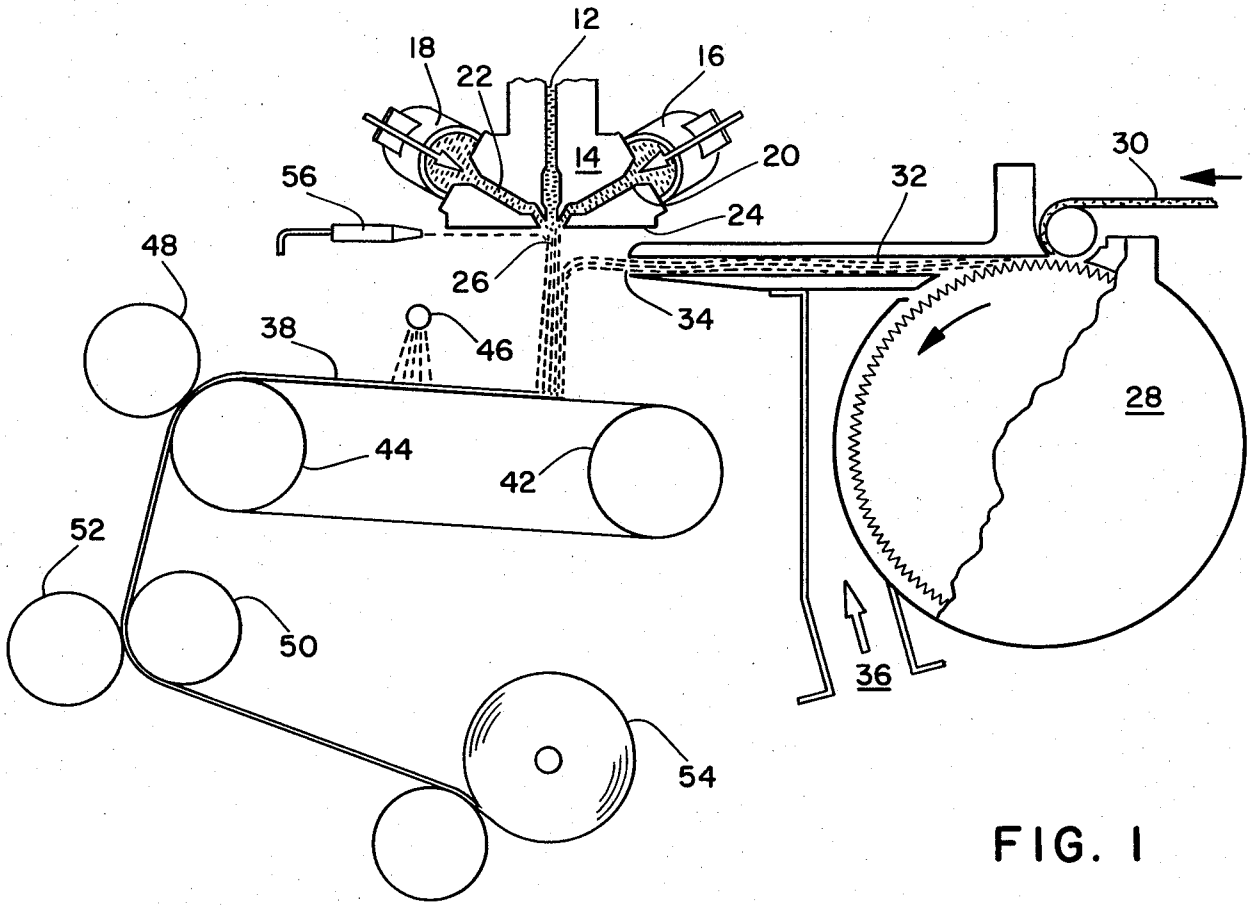
FIG. 1 is a schematic view of the process useful to prepare webs of the present invention.

While the invention will be described in connection with preferred embodiments, it will be understood that it is not intended to limit the invention to those embodiments. On the contrary, it is intended to cover all alternatives, modifications and equivalents as may be included within the spirit and the scope of the invention as defined by the appended claims.

To further illustrate the preparation of the fibrous sheet products of this invention, examples will be provided. To assist in understanding the examples, the following definitions and descriptions of methods employed will be helpful:

(1) the term "basis weight" as used herein refers to the weight in grams of one square meter of the particular fibrous sheet in question;

(2) the term "tensile strength" is the force in grams required to rupture a three inch wide sample of the dry fibrous sheet; the tensile strength is measured in both the machine direction (MD) and the cross machine direction (CD) using a Model 1130 Instron tester with a four inch jaw span and a crosshead speed of ten inches per minute;

(3) the term "% stretch" is the elongation at break of a sample of the fibrous sheet in the machine direction (MD) converted to percent. This measurement is also obtained on the Model 1130 Instron tester at the point of break;

(4) the term "Softness Test Rating" refers to the subjective feeling of a fibrous sheet, such as facial tissue, when touched. The values reported herein were obtained by averaging the values determined by at least eight trained sensory panelists, who evaluate each sample for stiffness, surface depth, and abrasiveness by comparing the sample to standard samples having a softness rating from 1 (least soft) to 15 (most soft).

The standards and samples to be tested are first subjected to the same temperature and relative humidity for and extended period of time (24 hours or longer).

One specimen of each standard needed is then placed in a row of ranked order. All specimens (including the standards) are placed flat on the table. The test specimen and the appropriate standard specimens are felt by placing the hand on the specimen with thumb and fingers spread with the base of the palm near a corner and the thumb and little finger each approximately parallel to an edge. The finger tips are moved toward the base of the palm and the thumb tip toward where the middle and index fingers join the palm so that (1) a loose mass is gathered in the palm and (2) two or more thicknesses project beyond the thumb across the middle and index fingers. The hand is then lifted and, if necessary, the thumb and fingers are manipulated to position the mass so it can be felt where the middle and index fingers join the palm. The thumb is placed on the thicknesses that lie across the middle and index fingers.

The fingers are opened and closed repeatedly, each time starting with the little finger and ending with the index finger. The mass is crushed lightly in the palm each time the fingers close, letting the fingers slide on the specimen as they will.

At the same time, the thumb is moved back and forth lightly on the thicknesses between it and the index and middle fingers. Limpness and surface texture are evaluated simultaneously as described below and combined with equal weight for a softness rating to the nearest 0.1 standard value. Most of the limpness evaluation is based on the pressure felt from the mass as the fingers open and close. Most of this pressure is felt where the middle and index fingers join the palm.

Most of the surface texture evaluation is based on the feel of the tissue between the thumb and the index and middle fingers as they move back and forth in opposite directions. The degree of unpleasant harshness and also the degree to which a pleasing velvet-like "nap" exists is evaluated. These are combined at equal weight in the evaluation of surface texture. Each sheet is rated to the nearest 0.1 scale interval.

(5) The term "Tensile Energy Absorption" is the area under the stress/strain relationship curve for a sample of the dry or wet fibrous sheet.

(6) The term "Invariant Tensile Energy Absorption" is the square root of the product of the tensile energy absorption in the machine direction and the cross direction for a sample of the fibrous sheet.

The meltblown fiber component of the present invention may be formed from any thermoplastic composition capable of extrusion into microfibers. Examples include polyolefins such as polypropylene and polyethylene, polyesters such as polyethylene terephthalate, polyamides such as nylon, as well as copolymers and blends of these and other thermoplastic polymers. Preferred among these for economy as well as improved wiping properties is polypropylene. The cellulosic fiber component should include fibers having a length in the range of about $\frac{1}{4}$ to about 4 mm and an average length of about 1 mm. Preferably the fibers are hardwood pulp or a fine textured softwood. Fibers should have a coarseness coefficient below about 20 and preferably below about 15 milligrams per meter. These compositions, it will be recognized, may also contain minor amounts of other fibers and additives which will not adversely affect properties of the resulting tissues.

A process for making the tissue material of the present invention may employ apparatus as generally described in U.S. Pat. No. 4,100,324 to Anderson, Sokolowski and Ostermeier which is incorporated herein by reference. In particular, reference to FIG. 1 hereof, in general, a supply 12 of polymer is fed from an extruder (not shown) to die 14. Air supply means 16 and 18 communicate by channels 20 and 22 to a die tip 24 through which is extruded polymer-forming fibers 26. Picker 28 receives bulk waste fibers 30 and separates them into individual fibers 32 fed into channel 34 which communicates with air channel 36 to a die tip 24. These fibers are mixed with meltblown fibers 26 and incorporated into a matrix 38 which is compacted on forming screen 40 moving on rollers 42 and 44 between roll 44 and pattern roll 48. The compacted matrix may be sprayed with water by water spray 46 before being embossed. From the embossing rolls, the matrix is fed between two calender rolls 50 and 52 and then fed to reel 54 for later conversion.

The embossing pattern is preferably selected to impart favorable textile-like tactile properties while providing strength and durability for intended use. The temperature of at least one of the rolls 44 or 48 should be in the range from about 150° to about 300° F. and preferably about 200° F. where meltblown fibers are polypropylene and the fibers are hardwood and the tissue speed between rolls 44 and 48 is about 100 feet per minute.

The bond pattern will preferably result in individual embossments over about 15% to about 35% of the material surface and preferably about 20% to about 30%. The concentration of individual bonds is preferably in the range of about 100 to 1,500 bonds per square inch. The embossing pressure should not exceed about 7000 psi. Preferably the pressure is between about 250 and about 5000 psi. The embossing roll may be either fabric or metal. For the preferred embossing areas, a pressure in the range of from about 70 pli to about 225 pli is preferred and more preferably at least 100 pli for 25% bond area. For a different bond area, the preferred pressure may be obtained by multiplying the ratio of percent areas to maintain constant psi on an individual bond point.

The embossed area should consist of individual fibers fused together at intersections between fibers but not fused to a point where the fibers are not discrete. The embossed areas should have a tissue thickness of about $\frac{1}{3}$ to $\frac{2}{3}$ of the original thickness of the tissue. Preferably the thickness is about $\frac{1}{2}$ of the original thickness.

When rapid fiber quenching is desired, the filaments 26 may be treated by spray nozzle 56, for example, during manufacture. The material may be treated for water wettability with a surfactant as desired. Numerous useful surfactants are known and include, for example, anionic and ionic compositions described in U.S. Pat. No. 4,307,143 to Meitner. For most applications requiring water wettability, the surfactant will be added at a rate of about 0.15% to about 1% by weight on the tissue after drying.

Figure 2:
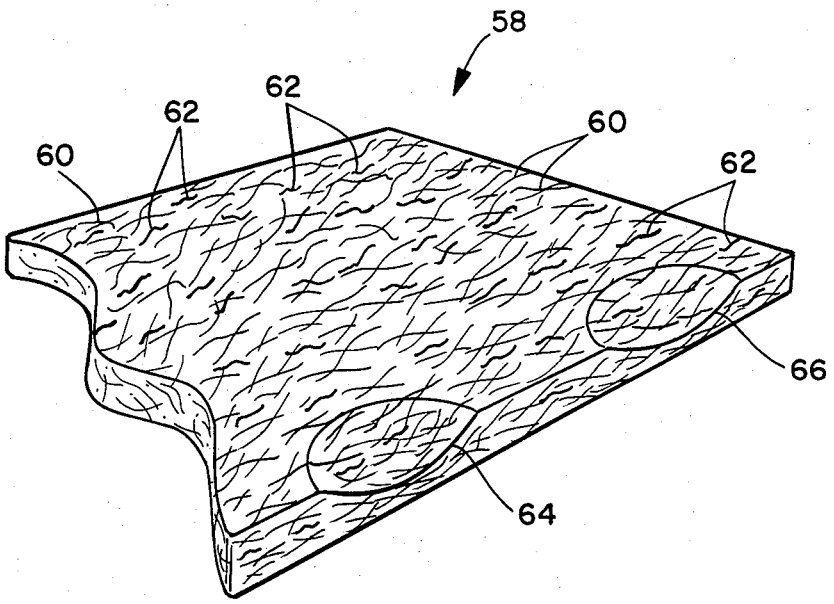
FIG. 2 is an enlarged view of a partial cross section of an unbonded tissue web produced in accordance with the invention.

Turning to the schematic illustration of FIG. 2, an embodiment of wiper material of the present invention will be described. As shown after embossing, wiper 58 is formed from a microfiber web incorporating a generally uniform dispersion of hardwood fibers 62. The embossed regions are shown at points 64 and 66. While it is not desired to limit the invention to any specific theory, it is believed that the improved performance is obtained by the hardwood fibers separating the fine microfibers of the thermoplastic and producing voids for absorption of liquids. Furthermore, the nature of the fibers is believed to contribute to the improved texture, wettability and clean tissue properties. Further, the controlled bond area and embossing temperature and pressures result in a tissue having a large number of embossed points in which the fibers are discrete but reduced in height by about $\frac{1}{3}$ to $\frac{2}{3}$. Depending upon the particular properties desired for a tissue, the percent of hardwood fibers in the matrix may vary in the range from about 20% to about 70% by weight with the range of about 40% to 60% by weight preferred. In general, the greater amount of cellulosic fibers added, the more improved will be the clean tissue capacity properties. The basis weight will also vary depending upon the desired tissue applications, but will normally be in the range of about 20 to about 50 g/m$^2$ and preferably in the range of about 25 to 30 g/m$^2$.

Preferably, the tissue of this invention has a Softness Test Rating of at least about 8 and an Invariant Tensile Energy Absorption of at least about 15. More preferably, the tissue has a Softness Test Rating of at least about 9.5 and most preferably about 10. More preferably the Invariant Absorption is at least about 20, most preferably about 30.

EXAMPLES

The invention will now be described with reference to specific examples. The invention will be described in reference to certain tests carried out on material of this invention, as well as conventional facial tissues. These tests are performed as follows:

EXAMPLE I

Using the apparatus assembled generally as described in FIG. 1 having a picker set for feed roll to nose bar clearance of 0.003 inches, nose bar to picker distance of 0.008 inches and picker speed of 3200 RPM, polypropylene was extruded at a barrel pressure of 312 PSIG at a temperature of 537° F. to 609° F. to form microfibers with primary air at 506° F. at a fiber production rate of 32#/hr. To these microfibers in the attenuating air stream was added an indicated weight % of a mixture of cellulosic fibers. The resulting 8 matrixes were embossed at a temperature of 200° F. and a pressure of 125 pli in a pattern covering 25% of the surface area of about 800 bonds per square inch. The eight samples (1-8) were compared to the conventional commercial products on the basis of tensile strength and softness. The commercial products compared are included in Table 1 as No. 9—Puff® and No. 10—Special Touch®. The result of the comparison is present in Table 1 below.

TABLE 1

| Sample I.D. | #1 | #2 | #3 | #4 | #5 |
|---|---|---|---|---|---|
| Basis Weight-Gsm | 34.0 | 33.2 | 26.9 | 35.8 | 28.6 |
| Pulp/Poly Ratio | 70/30 | 70/30 | 70/30 | 50/50 | 50/50 |
| Tensile Strength-gms/3" | | | | | |
| MD Dry | 1015 | 1174 | 1137 | 1138 | 1116 |
| % MD Stretch | 17.2 | 13.0 | 14.1 | 16.1 | 19.7 |
| CD Dry | 818 | 743 | 532 | 640 | 621 |
| % CD Stretch | 50.5 | 50.3 | 58.9 | 53.9 | 44.4 |
| CD Wet | 906 | 927 | 653 | 722 | 713 |
| % CD Wet | — | — | — | — | — |
| Absorbent Rate | 3.4 | 3.8 | 6.0 | 6.0 | 2.6 |
| Softness Test | | | | | |
| Rating | 10.7 | 10.6 | 10.9 | 10.8 | 10.7 |
| Stiff | 2.7 | 2.6 | 2.3 | 2.7 | 2.4 |
| Surface Depth | 8.7 | 8.4 | 8.5 | 8.5 | 8.1 |
| Abrasive | 2.6 | 2.5 | 2.5 | 2.1 | 2.1 |
| Absorbency- | | | | | |
| Gm Fiber/Gm $H_2O$ | 7.07 | 6.83 | 7.85 | 7.19 | 7.23 |
| Gm/4 × 4 | 51.90 | 49.86 | 44.76 | 56.66 | 46.26 |
| Sample I.D. | #6 | #7 | #8 | #9 | #10 |
| Basis Weight-Gsm | 29.3 | 33.6 | 28.6 | | |
| Pulp/Poly Ratio | 50/50 | 50/50 | 50/50 | | |
| Tensile Strength-gms/3" | | | | | |
| MD Dry | 1411 | 1258 | 1438 | 1451 | 1657 |
| % MD Stretch | 25.4 | 18.0 | 28.5 | 26.9 | 23.1 |
| CD Dry | 803 | 826 | 913 | 642 | 853 |
| % CD Stretch | 52.2 | 46.9 | 493 | 4.8 | 7.2 |
| CD Wet | 914 | 856 | 859 | 195 | 197 |
| % CD Wet | — | — | 44.2 | 7.2 | 9.9 |
| Absorbent Rate | 3.0 | 3.6 | — | 15.5 | 11.0 |
| Softness | | | | | |
| Rating Test | 10.6 | 10.0 | — | 8.1 | 8.9 |
| Stiff | 2.5 | 3.0 | — | 4.5 | 3.9 |
| Surface Depth | 8.3 | 7.6 | — | 5.5 | 6.6 |
| Abrasive | 2.7 | 2.2 | — | 2.1 | 2.5 |
| Absorbency- | | | | | |
| Gm Fiber/Gm $H_2O$ | 6.88 | 6.78 | — | 9.58 | 10.47 |
| Gm/4 × 4 | 43.39 | 49.81 | — | 59.5 | 89.7 |

EXAMPLE II

Sample #8 was compared to two commercial products on the basis of tensile energy absorption and the invariant tensile energy absorption. The results are present in Table 2 below.

TABLE 2

| | Tensile Energy Absorption g-cm/cm$^2$ | | |
|---|---|---|---|
| | #8 | #9 | #10 |
| MD | 40.84 | 15.24 | 23.89 |
| CD | 41.08 | 2.14 | 4.49 |
| Wet CD | 32.78 | 2.81 | 6.12 |
| Invariant | 40.96 | 5.7 | 10.3 |

As is demonstrated by the above Examples, the tissue material of the present invention provides a unique combination of excellent absorbent properties while having softness and strength. It is thus apparent that there has been provided, in accordance with the invention, a tissue material that fully satisfies the objects set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. An embossed nonwoven tissue having a total basis weight of from about 20 to about 50 g/m$^2$ comprising from about 30 to about 80 weight percent meltblown thermoplastic microfibers and from about 20 to about 70 weight percent cellulosic fibers, said tissue having an embossed bonding pattern concentration of from about 100 to about 1500 embossed areas per square inch wherein the thickness of the embossed areas is from about one-third to about two-thirds of the original thickness of the tissue and wherein the thermoplastic microfibers within the embossed areas remain as substantially discrete fibers.

2. The tissue of claim 1 wherein said microfibers comprise from about 40 to about 60 weight percent.

3. The tissue of claim 1 wherein said tissue comprises a total basis weight of from about 25 to about 30 grams per square meter.

4. The tissue of claim 1 wherein said cellulosic fibers have a coarseness coefficient below about 20 milligrams per meter.

5. The tissue of claim 4 wherein said cellulosic fibers have a coarseness coefficient below about 15 milligrams per square meter.

6. The tissue of claim 1 wherein said tissue is embossed from about 15% to about 35% of its surface area.

7. The tissue of claim 1 wherein said tissue is embossed with a fabric line pattern having a frequency of from about 15 to about 150 lines per inch.

8. The tissue of claim 1 wherein said tissue consists of one ply.

9. The tissue of claim 1 wherein said cellulosic fibers comprise hardwood fibers.

10. The tissue of claim 1 wherein said tissue has a Softness Test Rating of at least 8.

11. The tissue of claim 12 wherein said tissue has a Softness Test Rating of at least 9.5.

12. The tissue of claim 1 having an Invariant Tensile Energy Absorption of at about 15.

13. The tissue of claim 10 having an Invariant Tensile Energy Absorption of at least about 20.

14. The tissue of claim 11 having an Invariant Tensile Energy Absorption of at least about 30.

15. The tissue of claim 1 wherein said thermoplastic microfibers are selected from a group consisting of polyethylene and polypropylene.

16. The tissue of claim 1 wherein said tissue is embossed over about 20% to about 30% of its surface with embossed points frequency of about 250 to about 5,000 points per square inch.

17. The tissue of claim 1 wherein said tissue comprises from about 0.15% to 1% by weight surfactant.

18. The tissue of claim 1 wherein the embossed bonding pattern concentration is about 800 embossed areas per square inch.

* * * * *